US010463101B2

(12) United States Patent
Clark

(10) Patent No.: US 10,463,101 B2
(45) Date of Patent: Nov. 5, 2019

(54) COOLING HAT

(71) Applicant: Johnnie Clark, Mesa, AZ (US)

(72) Inventor: Johnnie Clark, Mesa, AZ (US)

( * ) Notice: Subject to any disclaimer, the term of this patent is extended or adjusted under 35 U.S.C. 154(b) by 123 days.

(21) Appl. No.: 15/713,474

(22) Filed: Sep. 22, 2017

(65) Prior Publication Data

US 2019/0150551 A1 May 23, 2019

Related U.S. Application Data

(60) Provisional application No. 62/399,081, filed on Sep. 23, 2016, provisional application No. 62/483,860, filed on Apr. 10, 2017.

(51) Int. Cl.
*A42C 5/04* (2006.01)
*A42B 1/06* (2006.01)

(52) U.S. Cl.
CPC ..... *A42C 5/04* (2013.01); *A42B 1/062* (2013.01)

(58) Field of Classification Search
CPC A42C 5/04; A42B 1/118; A42B 1/062; A42B 1/063
USPC ..... 2/175.1, 209.12, 195.1
See application file for complete search history.

(56) References Cited

U.S. PATENT DOCUMENTS 488,989 A * 1/1893 Davies ..... A42C 5/04 2/171.8
945,268 A * 1/1910 Dodd ..... A42B 1/02 2/175.1
1,250,968 A * 12/1917 Claussen ..... A42B 1/248 2/195.1
2,286,202 A * 6/1942 Fischer ..... A42B 1/062 2/181.6
2,557,123 A * 6/1951 Lyon ..... A42C 5/04 2/182.6
2,651,044 A * 9/1953 Stan ..... A42B 1/066 2/171
2,874,387 A * 2/1959 Bannister ..... A42B 1/062 2/195.1
2,875,447 A * 3/1959 Goldmerstein ..... A42C 5/02 2/209.3
2,908,012 A * 10/1959 Feldman ..... A42B 1/06 43/57.1
3,206,766 A * 9/1965 Smith ..... A42C 5/04 2/209.7
3,766,565 A * 10/1973 Cozzens ..... A42B 1/06 2/209.7
3,780,382 A * 12/1973 Boden ..... A42C 5/04 2/182.6
3,925,821 A * 12/1975 Lewicki ..... A42B 3/281 2/425
RE29,452 E * 10/1977 Townsend, Jr. ..... A42C 5/04 2/209.7

(Continued)

OTHER PUBLICATIONS

International Search Report for PCT/US2017/053084 dated Dec. 11, 2017, 1 page.

*Primary Examiner* — Jameson D Collier
*Assistant Examiner* — Heather N Mangine
(74) *Attorney, Agent, or Firm* — Snell & Wilmer, L.L.P.

(57) ABSTRACT

A hat includes a brim having a front portion and a back portion. The hat also includes a crown which is coupled with the back portion of the brim. The brim includes one or more intake ports placed along the back portion of the brim and the crown includes one or more exhaust ports.

14 Claims, 8 Drawing Sheets

(56) References Cited

U.S. PATENT DOCUMENTS 4,101,981 A * 7/1978 Boden ..... A42C 5/04 2/171.3
4,114,201 A * 9/1978 Garrison ..... A42B 1/062 2/209.7
4,274,157 A * 6/1981 Boden ..... A42C 5/04 2/181.4
4,292,689 A * 10/1981 Townsend, Jr. ..... A61F 9/045 2/12
4,429,420 A * 2/1984 Wolff ..... A42B 1/208 2/175.1
4,476,589 A * 10/1984 Burgin ..... A42C 5/04 2/184.5
4,551,860 A * 11/1985 Smit ..... A42B 1/004 2/175.1
4,850,049 A * 7/1989 Landis ..... A42B 1/043 2/10
4,993,081 A * 2/1991 Fulghum ..... A42B 3/227 2/209.12
5,085,231 A * 2/1992 Johnson ..... A24F 47/00 131/329
5,101,516 A * 4/1992 Scarnato ..... A42C 5/02 2/181
5,155,868 A * 10/1992 McLean, Jr. ..... A42B 7/00 2/173.5
5,157,788 A * 10/1992 Schultz ..... A42B 1/04 2/195.1
5,487,191 A * 1/1996 Ridley ..... A42B 1/062 2/10
5,495,622 A * 3/1996 Kaufman ..... A42B 1/066 2/175.1
5,553,327 A * 9/1996 Koecher ..... A42B 1/02 2/175.1
5,657,490 A * 8/1997 Edmark ..... A42B 1/201 2/171.03
5,781,933 A * 7/1998 De Giacomi ..... A61F 9/045 2/195.1
5,855,023 A * 1/1999 Clingenpeel ..... A42C 5/04 2/181.6
5,926,849 A * 7/1999 Boyle ..... A42B 1/22 2/181.2
5,956,759 A * 9/1999 Benedict ..... A42C 5/04 2/171.2
6,199,214 B1 * 3/2001 Campbell ..... A42B 3/28 2/181.6
6,367,084 B1 * 4/2002 Keast ..... A42C 5/04 2/182.7
D565,640 S * 4/2008 Estrem ..... D16/330
7,398,560 B1 * 7/2008 Swensen ..... A42C 5/04 2/182.2
D592,835 S * 5/2009 Wilson ..... D2/893
8,516,617 B1 * 8/2013 Kazmierczak ..... A42C 5/04 2/171.3
8,640,264 B2 * 2/2014 Ramer ..... A42B 1/062 2/171.3
9,226,538 B2 * 1/2016 Kim ..... A42B 3/227
D749,303 S * 2/2016 York ..... D2/872
9,480,292 B1 * 11/2016 Kazmierczak ..... A42C 5/04
10,051,906 B1 * 8/2018 Kazmierczak ..... A42C 5/04
2002/0078491 A1 * 6/2002 Held ..... A42C 5/04 2/171.3
2004/0006807 A1 * 1/2004 Wang ..... A42B 1/062 2/195.1
2005/0223474 A1 * 10/2005 Cho ..... A42B 1/22 2/195.3
2006/0174397 A1 * 8/2006 Taguchi ..... A42B 1/062 2/195.6
2006/0191061 A1 * 8/2006 Rampell ..... A42B 1/008 2/410
2007/0017003 A1 * 1/2007 Harris ..... A42B 1/064 2/195.1
2011/0252539 A1 * 10/2011 Scott ..... A42B 1/062 2/209.5
2012/0198600 A1 * 8/2012 Niazi ..... A42B 1/02 2/175.1
2013/0031701 A1 * 2/2013 Krauter ..... A42B 1/08 2/411
2013/0263358 A1 * 10/2013 Fleischmann ..... A42B 1/008 2/182.8
2015/0000008 A1 * 1/2015 Shirai ..... A42B 1/008 2/195.1
2015/0020292 A1 * 1/2015 Diaz ..... A42C 5/04 2/171.2
2015/0143613 A1 * 5/2015 Chu ..... A42B 1/008 2/171.3
2015/0237642 A1 8/2015 Ihm et al.
2016/0000172 A1 * 1/2016 Cho ..... A42B 1/062 2/181
2016/0007672 A1 * 1/2016 Ku ..... A42B 1/24 2/171.3
2016/0353824 A1 * 12/2016 Smith ..... A42B 1/22
2017/0215513 A1 * 8/2017 Crunk ..... A42C 5/04

* cited by examiner

COOLING HAT

CROSS-REFERENCE TO RELATED APPLICATIONS

The present disclosure is related to that disclosed in the U.S. Provisional Application No. 62/399,081, filed Sep. 23, 2016, entitled "Cooling Hat" and the U.S. Provisional Application No. 62/483,860, filed Apr. 10, 2017, entitled "Cooling Hat." The subject matter disclosed in U.S. Provisional Application Nos. 62/399,081 and 62/483,860 is hereby incorporated by reference into the present disclosure as if fully set forth herein. The present invention hereby claims priority under 35 U.S.C. § 119(e) to U.S. Provisional Application Nos. 62/399,081 and 62/483,860.

TECHNICAL FIELD

The present disclosure relates generally to a head cooling device and specifically to a hat with increased airflow and cooling properties.

BACKGROUND

A frequent problem with hats is that they do not provide enough air flow around the wearer's head, but instead only cause heat to gather inside the hat and cause sweating on the wearer. Traditionally hats have been designed to have a vent on the back of a hat or at the top of a hat. A problem with this design is that it only provides a way for heat to rise out of these vents, but the design does nothing to circulate air around the head of a wearer. This inability to allow airflow around and over a wearer's head is undesirable.

BRIEF DESCRIPTION OF THE DRAWINGS

A more complete understanding of the present invention may be derived by referring to the detailed description when considered in connection with the following illustrative figures. In the figures, like reference numbers refer to like elements or acts throughout the figures.

DETAILED DESCRIPTION

Figure 1:
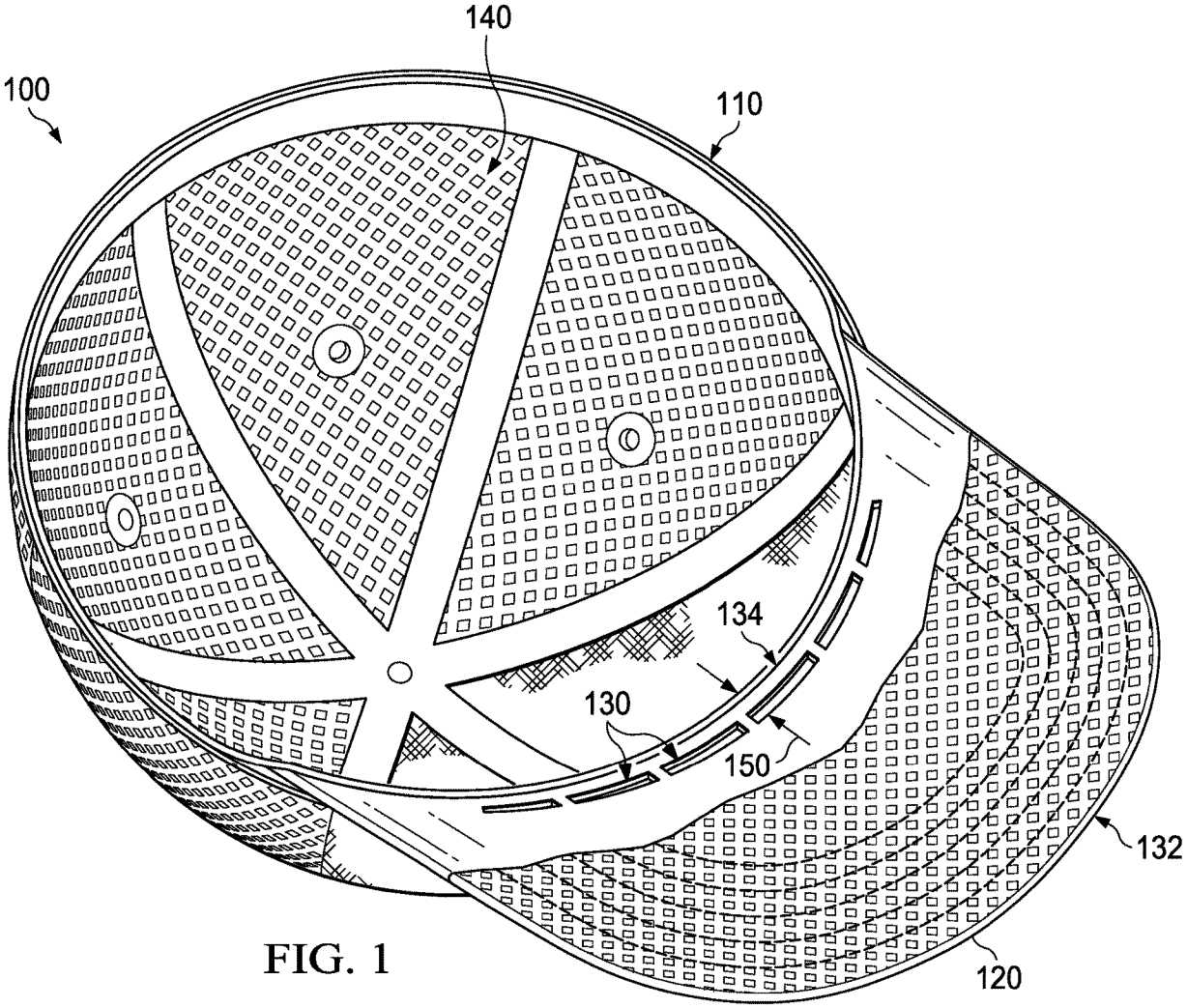
FIG. 1 illustrates an underside view of an exemplary hat according to an embodiment.

Aspects and applications of the invention presented herein are described below in the drawings and detailed description of the invention. Unless specifically noted, it is intended that the words and phrases in the specification and the claims be given their plain, ordinary, and accustomed meaning to those of ordinary skill in the applicable arts.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

FIG. 1 illustrates an underside view 100 of an exemplary hat 110 according to an embodiment. Hat 110 comprises a unique design and configuration that provides for airflow around and over the head of a wearer. Hat 110 comprises a multiple port ventilation system that combines one or more intake ports 130 with one or more exhaust ports 140 to circulate airflow around and over the head of a wearer.

According to embodiments, the brim 120 may protrude outward from the base (e.g., bottom perimeter 180) of the hat 110. The brim 120 may comprise a front portion 132 that is also the front portion of the hat 110 and a back portion 134 (e.g., with a curved edge) that contacts with a wearer's head at the base of the hat 110. In addition, the brim 120 of hat 110 may comprise one or more intake ports 130 placed along the back portion 134 of the brim 120 in front of the portion of the hat 110 which that engages a wearer's head (e.g., flexible band 182). The one or more intake ports 130 placed in brim 120 creates a gap 150 between the front of a wearer's head and the front of the intake parts 130 of the brim 120 of the hat 110. The size, position and placement of the intake ports 130 (as discussed below in more detail) create in input or output of the gap 150 and direct air that flows under the brim 120 though the intake ports 130 and into the gap 150 (e.g., channel 184), around and over the wearer's head, and then flowing out the exhaust ports 140. In addition, and as discussed in more detail below, air may flow from one or more exhaust ports 140, around and over the wearer's head, through the gap 150 and out the intake ports 130 under the brim 120 in the front of the wearer's head. That is, in order to increase the airflow around and over the wearer's head, one or more exhaust ports 140 may be coupled to another portion of the hat 110 that allows air from the intake ports 130 to flow out of the hat 110.

According to embodiments, the hat 110 may comprise one or more exhaust ports 140 on the sides or the back of the hat 110. The air that enters the intake ports 130 in the front of the hat 110 may flow around and over the head of the wearer and through the one or more exhaust ports 140 in the back or sides of the hat 110. In this way, air may flow in through the front of the hat 110 and out through the back of the hat 110.

Although the intake ports 130 are shown and described substantially at the front of the hat 110, and the exhaust ports 140 are described substantially on the sides or on the back of the hat 110, embodiments contemplate any number or location of the intake ports 130 and the exhaust ports 140, according to particular needs. For example, locating the intake ports 130 on the front of the hat 110 under the brim 120 allows air collected under the brim 120 to be funneled up into the intake ports 130, through the gap 150, around and over the wearer's head, and exit the exhaust ports 140. In fact, the disclosed embodiments create a particularly strong air flow by collecting a large amount of air from under the surface area of the brim 120 and channeling that air though the gap 150 in the front of the wearer's head creating a strong cooling sensation. In addition, or as an alternative, any heat created from the wearer's head causes an air differential thereby increasing the airflow around and over the wearer's head and into and out of the intake ports 130 and exhaust ports 140.

According to some embodiments, the intake ports 130 and the exhaust ports 140 are sized to allow sufficient airflow to circulate around the wearer's head. According to embodiments, the exhaust port 140 is sized such that all air that flows in through the intake ports 130 is easily exhausted through the exhaust ports 140. Additionally, the intake ports 130 and the exhaust ports 140 may be sized to take into account the thermodynamic properties of the heat radiated by the head of the wearer. For example, the intake ports 130 and the exhaust ports 140 are sized to dissipate the heat from the head of a typical wearer. However, the intake ports 130 and exhaust ports 140 may be sized larger or smaller based on the amount of heat given off by the wearer, the size and type of hat 110, and/or the ambient heat of the environment.

Additionally, the intake ports 130 and the exhaust ports 140 may be sized to accommodate different wind environments. According to embodiments, the intake ports 130 and the exhaust ports 140 may be sized to allow sufficient wind to pass through the hat 110, such that, the wind does not blow the hat 110 off of the wearer's head. For example, the intake ports 130 may comprise a smaller size opening so that increased airflow through the hat 110 does not blow the hat 110 off of the wearer's head. Additionally, or in the alternative, the exhaust ports 140 may be over-sized so that any amount of air that goes into the hat 110 may freely escape without blowing the hat 110 off of the wearer's head. In other words, if the exhaust ports 140 are too small, the hat 110 may blow off of the wearer's head.

Figure 2:
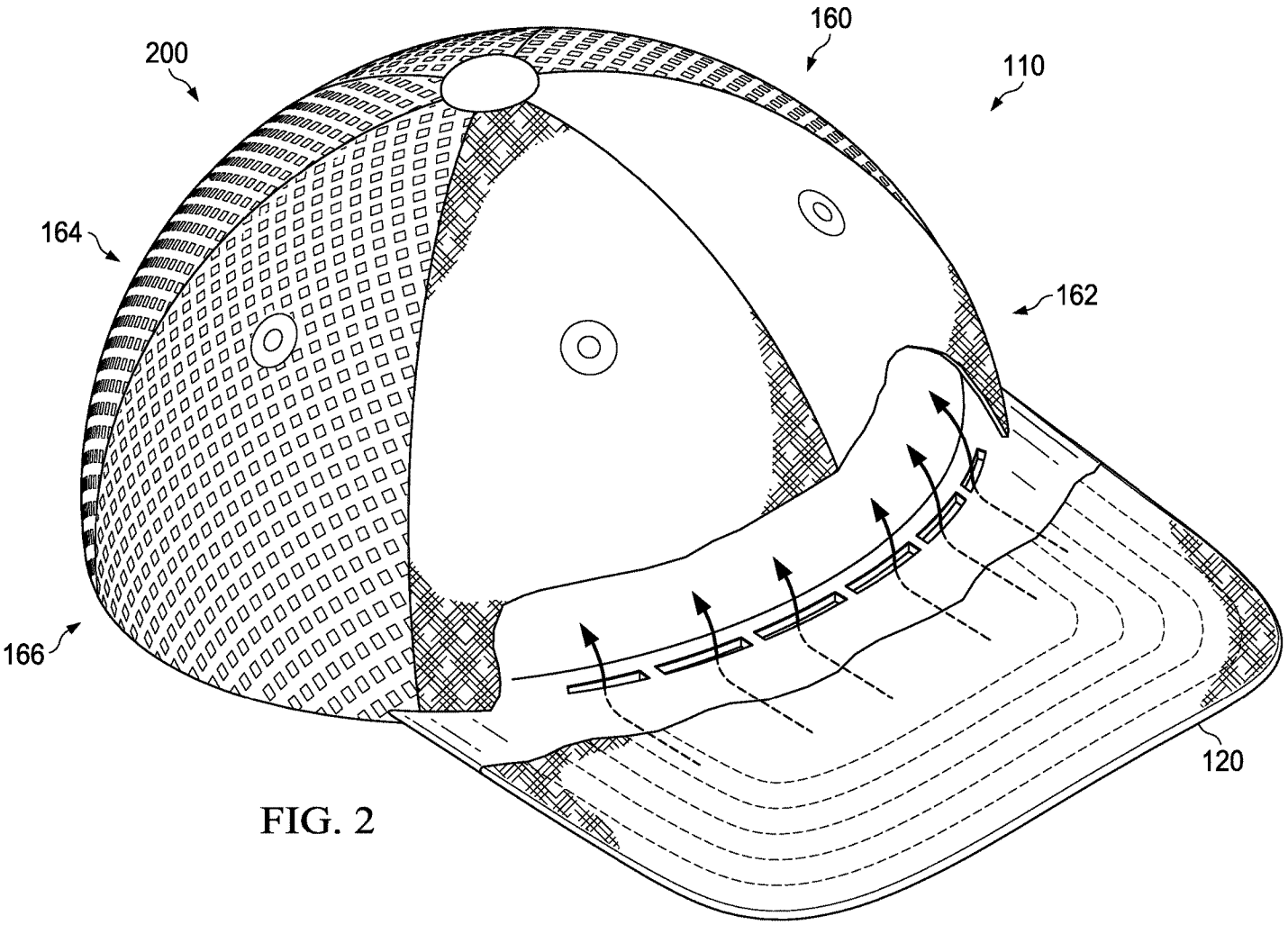
FIG. 2 illustrates a side view of the hat of FIG. 1 according to an embodiment.

FIG. 2 illustrates a side view 200 of the hat 110 of FIG. 1 according to an embodiment. According to embodiments, the hat 110 comprises the brim 120 and the crown 160 that covers the crown of a wearer's head. The crown 160 may comprise a front of the crown 162, a back of the crown 164 and sides of the crown 166. According to embodiments, the hat 110 comprises one or more exhaust ports 140 on the back of the crown 164 and/or on the sides of the crown 166. According to embodiments, the exhaust ports 140 serves as a ventilation system for the hat 110, as described in more detail herein. In one embodiment, the surface area of the exhaust port 140 is sized sufficiently larger than the surface area of intake ports 130, so that the amount of air that flows through the intake ports 130 is allowed to quickly exhaust, without impeding air flow. Conversely, the surface area of the exhaust port 140 is sized sufficiently larger than the surface area of intake ports 130, such that air may flow into exhaust port 140 and flow out of intake port 130, in for example, windy conditions.

According to embodiments, the exhaust ports 140 comprise a mesh or perforated surface formed from fabric, polymers, or other suitable materials.

Although, the exhaust ports 140 are shown to cover substantially the back of the crown 164 and sides of the crown 166 embodiments contemplate, any size, configuration or placement of the exhaust ports 140, according to particular needs.

Figure 3:
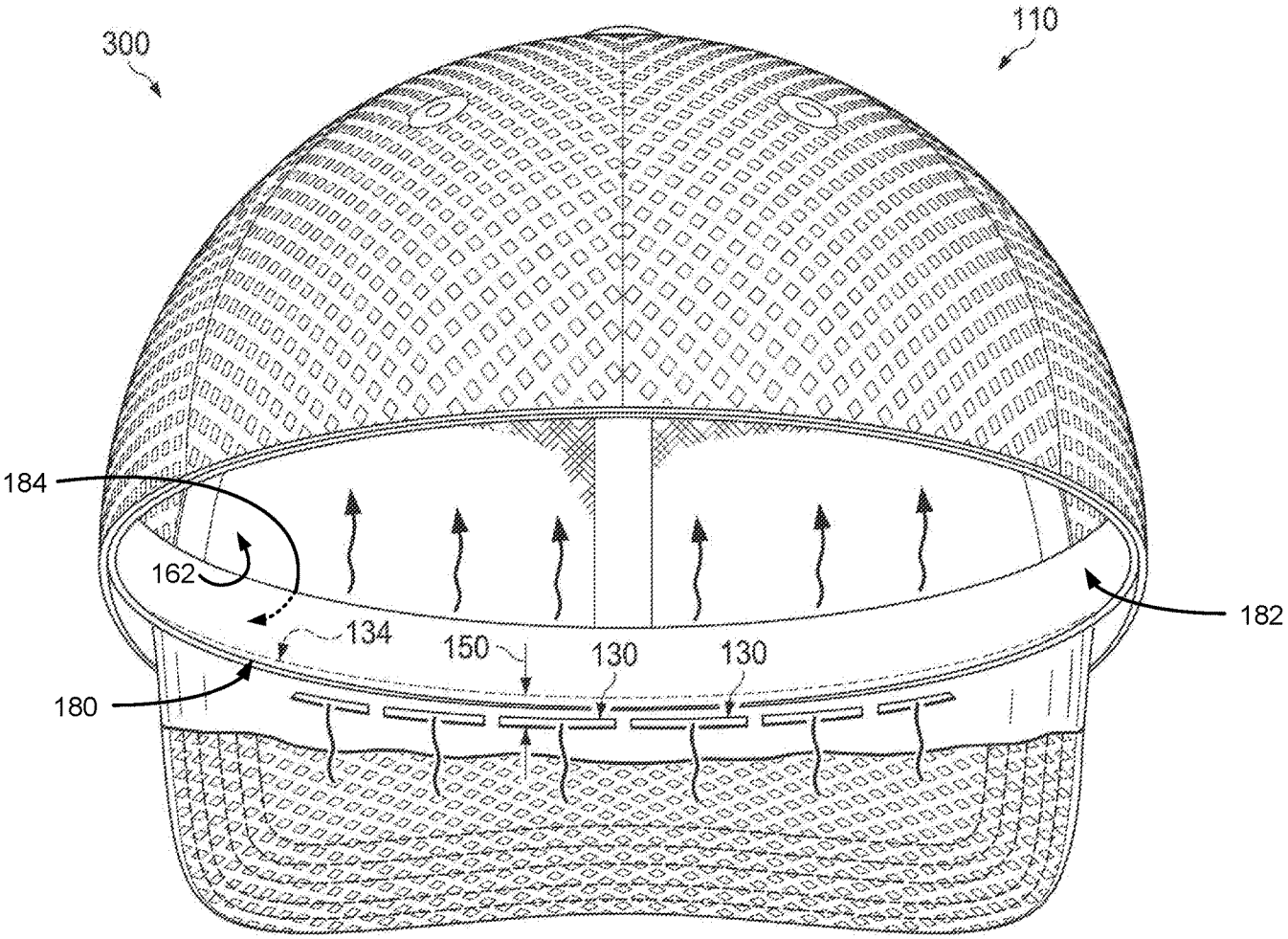
FIG. 3 illustrates an exemplary back view of the inside of the hat of FIG. 1 according to an embodiment.

FIG. 3 illustrates an exemplary back view 300 of the inside of the hat 110 of FIG. 1 according to an embodiment. As can be seen, the intake ports 130 in the brim 120 of the hat 110 may be located between the back portion 134 of the brim 120 and the front of the crown 162, thereby creating the gap 150. According to embodiments, this gap 150 is formed by extending the material of the brim 120 material inward toward the wearer's head so that the material of the brim 120 holds the front of the hat 110 outward from the head of the wearer, which creates the gap 150 between the front of the crown 162 and the wearer's head and allows for airflow along the forehead of a wearer's head.

Although the gap 150 is created by the brim 120, embodiments contemplate forming a gap 150 above the intake ports 130 and in front of the wearer's head by other suitable configurations, such as, for example, placing spacers or cushioning in front of the head of the user that creates a gap 150 in front of the head of the user. In addition, or as an alternative, although the brim 120 is shown and described at the front of the hat 110, embodiments contemplate the brim 120 being at any portion of the hat 110, such as, the back, the sides or all the way around the hat 110, depending on the style of hat. In these embodiments, the one or more intake ports 130 and one or more exhaust ports 140 may be located in the gap 150 between the front of the crown 162, back of the crown 164 and/or the sides of the crown 166 and the wearer's head.

According to embodiments, the intake ports 130 may then be covered by a breathable net or mesh (such as a fabric) so that the intake ports 130 are hidden behind the net or mesh to improve the aesthetic appearance of the hat 110 while not blocking airflow. According to some embodiments, the fabric may comprise openings that allow air to flow through the intake ports 130 and through or around the fabric.

According to other embodiments, the brim 120 material may be sewn inside a fabric covering the intake ports 130 either covered by a fabric or mesh or partially visible on the underside of the hat 110. In either configuration, the intake ports 130 provide for air traveling underneath the brim 120 to be directed over the wearer's head through the gap 150 between the front of the crown 162 and the wearer's head.

Figure 4:
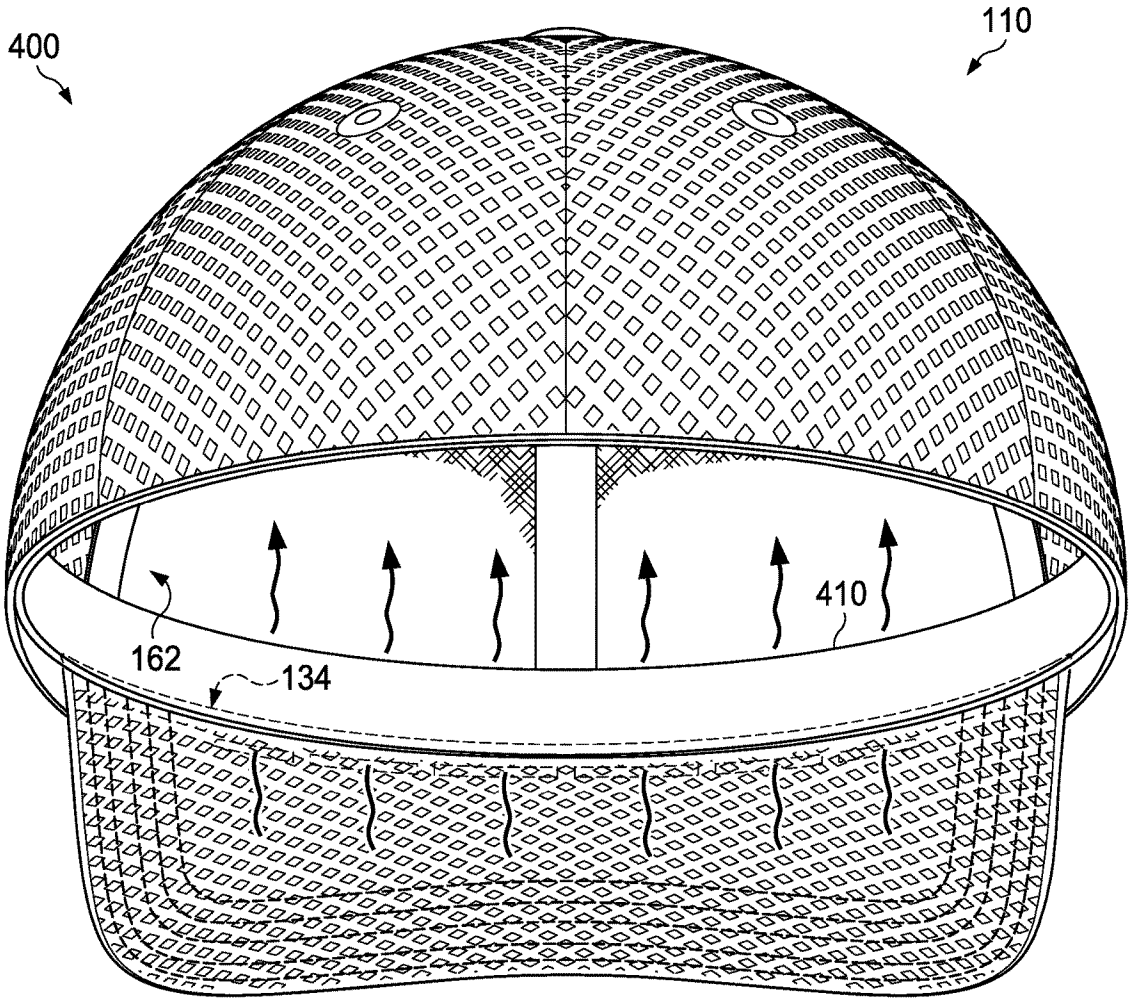
FIG. 4 illustrates an exemplary back view of the inside of the hat of FIG. 1 including a flexible band according to another embodiment.

FIG. 4 illustrates an exemplary back view 400 of the inside of the hat 110 of FIG. 1 including a flexible band 410 according to another embodiment. For some hats 110, such as a baseball cap, the brim 120 is sewn to the front of the hat 110. Although examples are shown and described with respect to baseball caps, embodiments contemplate various features of the disclosed embodiments being formed into cowboy hats, safari hats, beach hats, or any other hat, helmet, or head gear.

According to some embodiments, the hat 110 comprises a band 410 on the inside of the hat 110. According to one embodiment, the flexible band 410 may comprise an elastic material, such as, for example, such that the flexible band 410 is configured to grip the wearer's head. According to some embodiments, the intake ports 130 may be coupled to the inside of the brim 120 on the side of the flexible band 410 away from the wearer's head. In this way, the air flows through the intake ports 130 and through the gap 150 that is between the flexible band 410 and the front of the crown 162 of the hat 110, thereby cooling the flexible band 410. The gap 150 between the flexible band 410 and the front of the crown 162 may be configured, such that there is a quarter of an inch in width associated with the gap 150. Although a particular gap 150 is given as an example, embodiments contemplate larger or smaller gaps, according to particular needs. According to some embodiments, the flexible band 410 is tapered to fit wearer heads of various sizes.

Additionally, the flexible band 410 may comprise a stiffened portion that allows the flexible portion to tightly grip the wearer's head while forming a gap 150 between the front of the crown 162 and the wearer's head. The shape of a wearer's head, which ordinarily slopes backward away from the front of the hat 110, may be used to create a tapered gap 150 between the wearer's forehead and the front of the crown 162 by shaping the front of the crown 162 at a shallower angle than that of a typical forehead.

Figure 5:
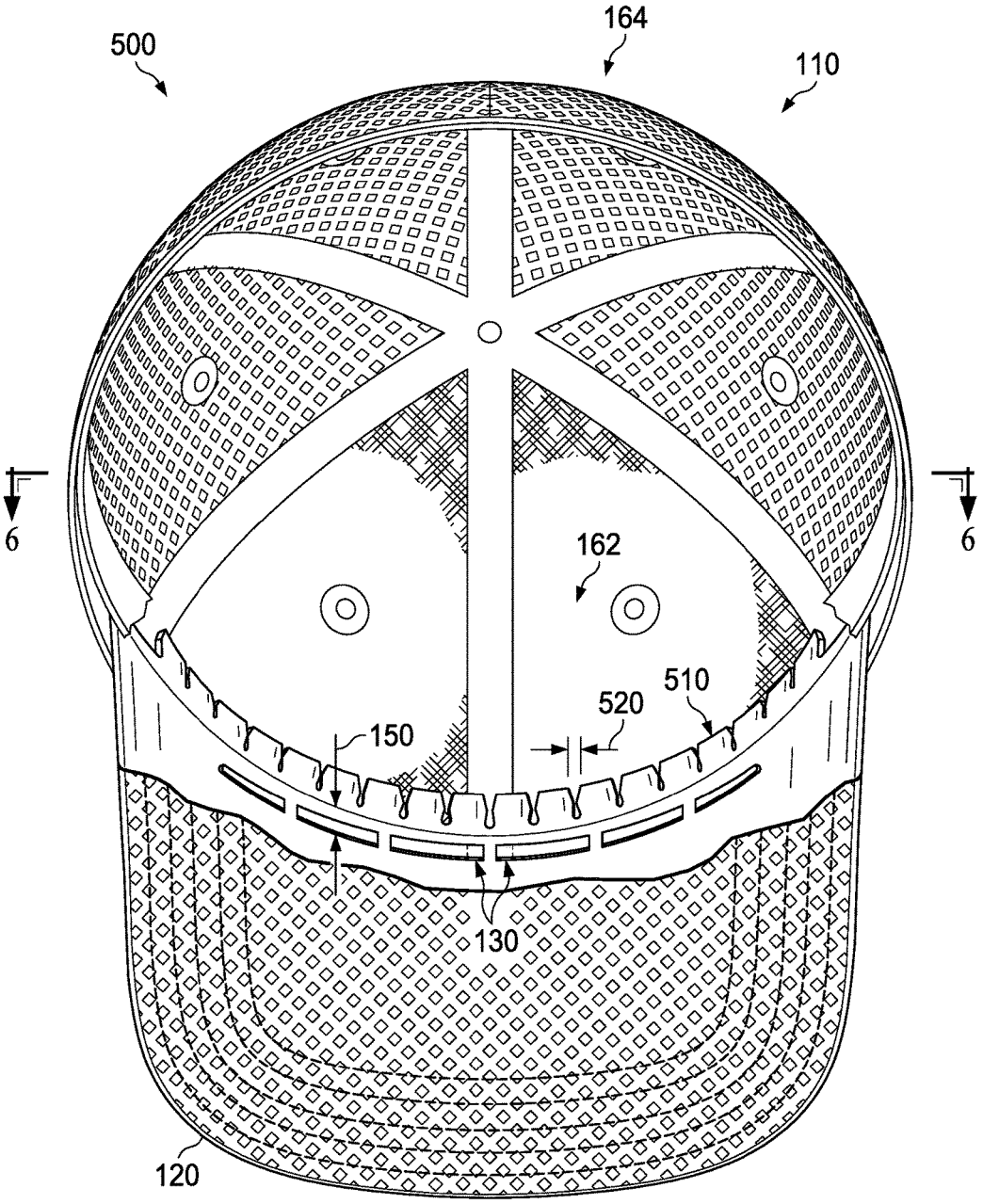
FIG. 5 illustrates an underside view with an alternate configuration of the brim including intake ports and structural tabs according to an embodiment.

FIG. 5 illustrates an underside view 500 with an alternate configuration of the brim 120 including intake ports 130 and structural tabs 510 according to an embodiment. According to embodiments, the brim 120 of the hat 110 may comprise one or more structural tabs 510 placed alongside the back edge of the brim 120 between the intake ports 130 and the front of the wearer's head. According to embodiments, the structural tabs 510 on the brim 120 of the hat 110 may be configured to increase the grip of the brim 120 to the hat 110 and help the intake ports 130 direct air that flows under the brim 120 into the gap 150 in the front of the wearer's head.

According to embodiments, the structural tabs 510 are substantially perpendicular to the brim 120 and may fold upward at the back of the brim 120 between the intake ports 130 and the front of the wearer's head. In addition, or as an alternative, the structural tabs 510 may be substantially aligned with the angle of the front of the crown 162. According to embodiments, the structural tabs 510 are formed from a semi-rigid material, such as bendable plastic, that may be incorporated into the brim 120 of the hat 110. Although a particular material is shown and described, embodiments contemplate any type of materials for the brim 120 and the structural tabs 510, according to particular needs.

According to embodiments, the brim 120 may comprise a certain number of structural tabs 510 folded up towards the inside edge of the hat 110. The structural tabs 510 may be sized such that the brim 120 of the hat 110 is not enlarged from what is suitable to a particular style of hat 110. According to embodiments, the structural tabs 510 are embedded within the edge of the brim 120 such that the brim 120 does not increase in size. According to some embodiments, the structural tabs 510 are sized and spaced as shown, such that the structural tabs 510 may be four times the size of the spacing 520 between the structural tabs 510. Although particular sizes of structural tabs 510 and spacing 520 between the structural tabs 510 are shown and described, embodiments contemplate any suitable size of structural tabs 510 or spacing 520 between the structural tabs 510, according to particular needs.

According to one embodiment, the brim 120 may comprise twenty structural tabs 510, no structural tabs 510, or any number of structural tabs 510. Although a particular number of structural tabs 510 have been shown and described, embodiments contemplate any number of structural tabs 510, according to particular needs. Additionally, or as an alternative, structural tabs 510 may each form a substantially square or rectangular shape. Although particular shapes and numbers of structural tabs 510 have been described, embodiments contemplate any shape, any number of shapes, or number of structural tabs 510, according to particular needs.

Figure 6:
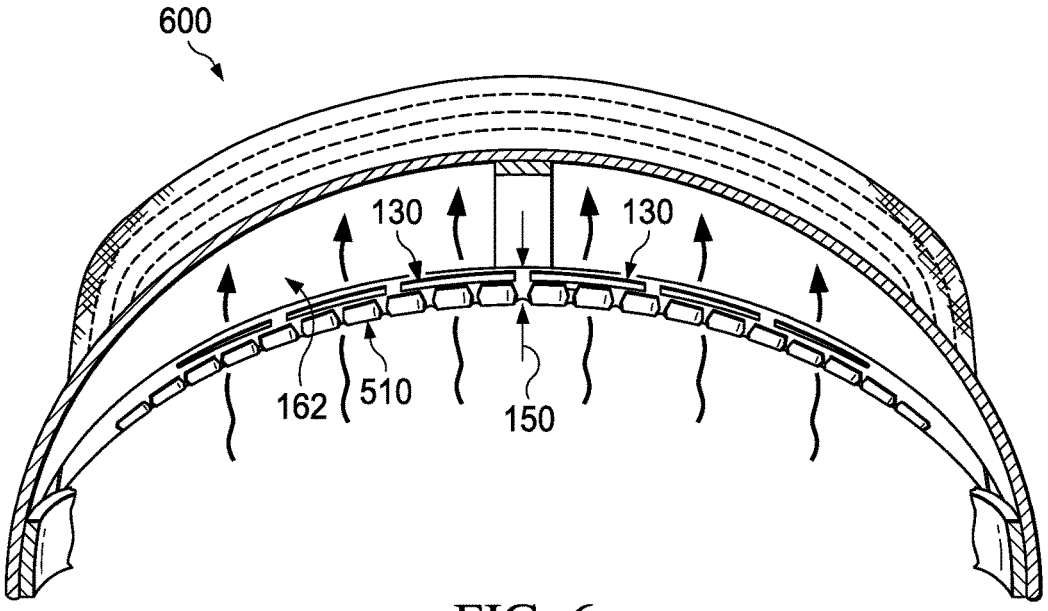
FIG. 6 illustrates a top view 600 of the inside of the hat 110 of FIG. 5, according to an embodiment.

FIG. 6 illustrates a top view 600 of the inside of the hat 110 of FIG. 5, according to an embodiment. As can be seen, the intake ports 130 in the brim 120 of the hat 110 may be located between the structural tabs 510 of the brim 120 and the front of the crown 162, thereby creating the gap 150. According to embodiments, this gap 150 is formed by extending the material of the brim 120 material inward toward the wearer's head so that the material of the brim 120 holds the front of the hat 110 outward from the head of the wearer, which creates the gap 150 between the front of the crown 162 and the structural tabs 510, thereby allowing for airflow along the forehead of a wearer's head.

According to one embodiment, a flexible band 410 is configured to grip the wearer's head, as discussed above in FIG. 4. According to some embodiments, the flexible band 410 may be coupled to the structural tabs 510 of the brim 120, thereby creating the gap 150 between the flexible band 410 and the front of the crown 162. In this way, the air flows through the intake ports 130 and through the gap 150 that is between the structural tabs 150 and the front of the crown 162 of the hat 110, thereby cooling the flexible band 410. Additionally, the structural tabs 510 provides a stiffened portion to the flexible band 410, as discussed above, that allows the flexible portion to tightly grip the wearer's head while forming a gap 150 between the front of the crown 162 and the wearer's head.

Figure 7A:
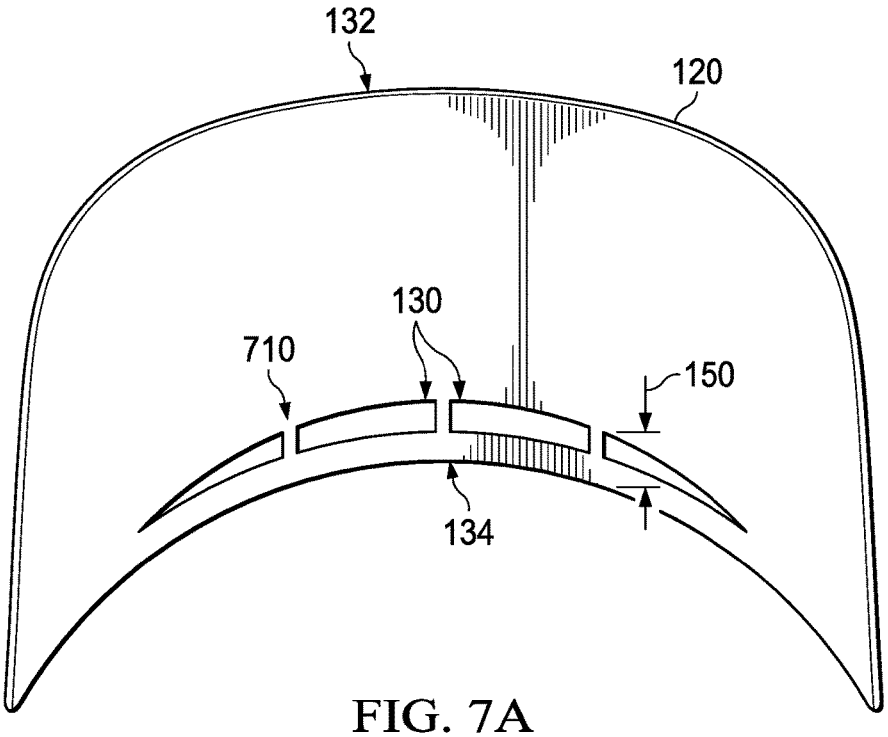
FIGS. 7A-7E illustrate exemplary embodiments of the intake parts 130 of the brim 120, according to an embodiment.
Figure 7B:
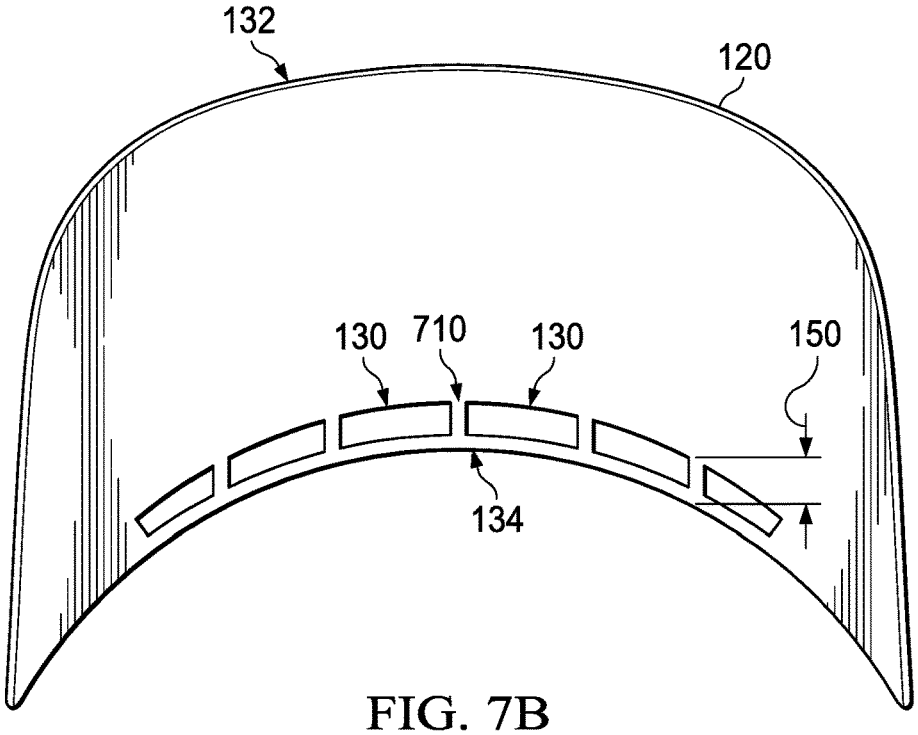
Figure 7C:
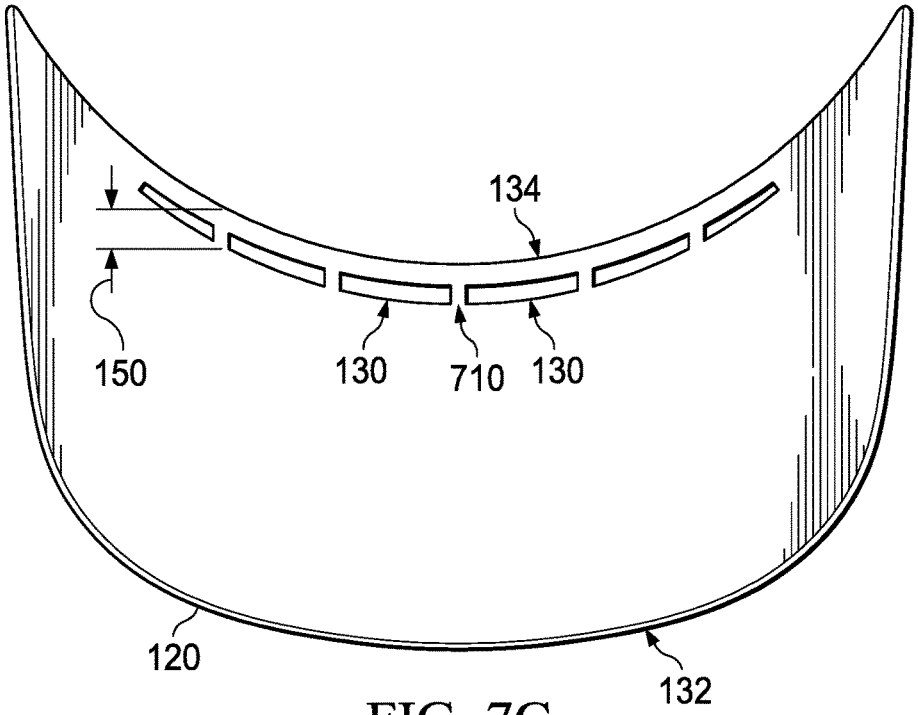
Figure 7D:
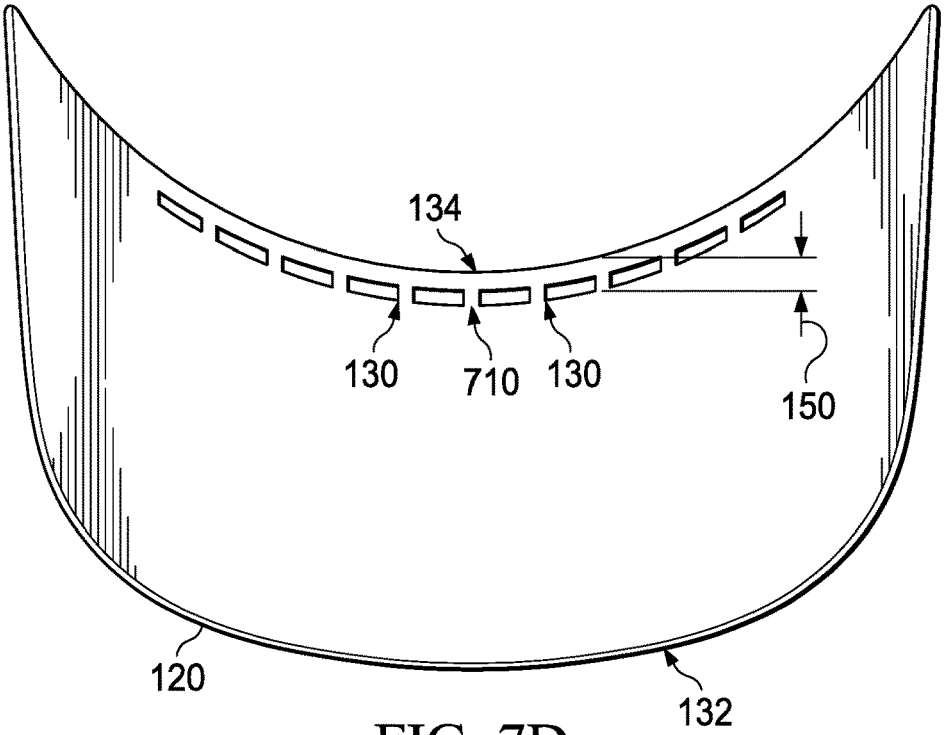
Figure 7E:
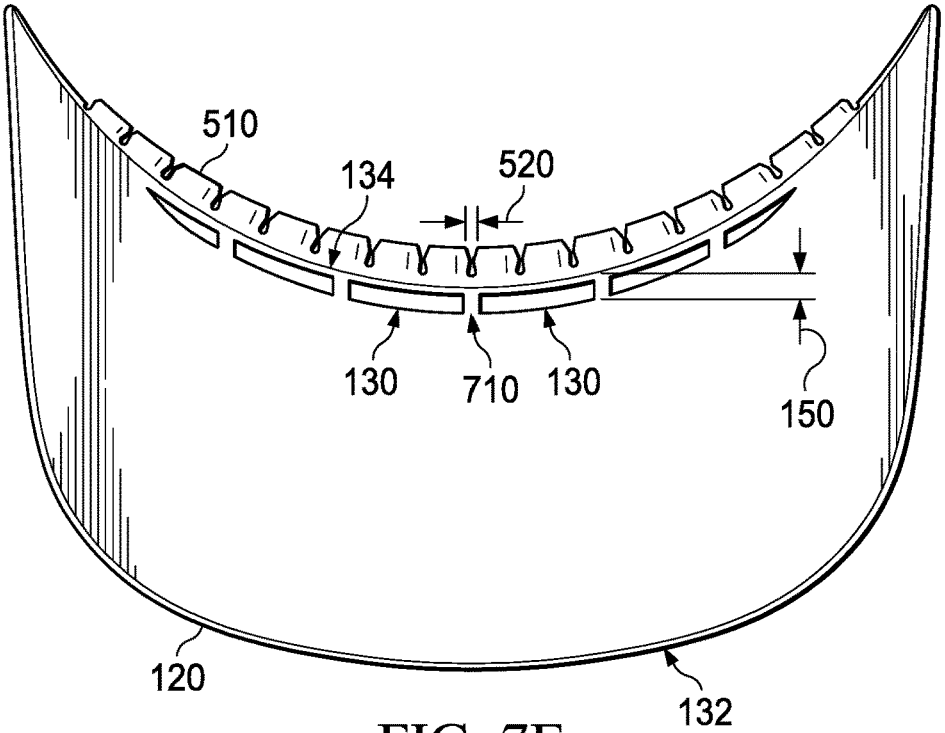

FIGS. 7A-7E illustrate exemplary embodiments of the intake parts 130 of the brim 120, according to an embodiment. According to embodiments, the intake ports 130 are formed from a semi-rigid material, such as a bendable plastic, that may be incorporated directly into the brim 120 of the hat 110. According to embodiments, the intake ports 130 may comprise one or more openings through the brim 120 material. According to embodiments, the brim 120 may comprise four intake ports 130 (as illustrated in FIG. 7A), six intake ports 130 (as illustrated in FIGS. 7B, 7C and 7E) or ten intake ports 130 (as illustrated in FIG. 7D). Although a particular number of intake ports 130 are shown and described, embodiments contemplate any number of intake parts 130, according to particular needs.

Additionally, or in the alternative, the intake ports 130 that are located toward the center of the brim 120 may be wider than the intake ports 130 located at the sides of the brim 120. According to some embodiments, openings toward the sides of the brim 130 may be tapered away from the center of the brim 130, such that, the intake ports 130 form a substantially triangular shape that decreases the width of the intake ports 130, at the sides of the hat 110. This may improve comfort to the wearer while also allowing suitable airflow through the intake ports 130.

According to embodiments, the brim 120 may comprise an increased number of intake ports 130, such as ten intake parts 130, shown in FIG. 7D, which allow for an increased number of reinforcement 710 between each of the one or more intake ports 130. This may increase rigidity of the brim 120, while still allowing sufficient airflow through the intake ports 130.

The intake ports 130 may be sized such that the brim 120 of the hat 110 is not enlarged from what is suitable to particular style of hat 110. For example, a baseball cap may comprise a brim 120 of a particular size and configuration. According to embodiments, the intake ports 130 are embedded within the brim 120 such that the brim 120 does not increase in size. According to some embodiments, the intake ports 130 are between one-eighth and three-eighths of an inch in width. According to other embodiments, the intake ports 130 are between one-sixteenth and three-sixteenths of an inch in width. According to yet other embodiments, the reinforcements 710 are between one-sixteenth and one-quarter of an inch in width. For example, one or more of the reinforcements 710 may be one-eighth of an inch wide. Although particular sizes of intake ports 130 and reinforcements 710 are shown and described, embodiments contemplate any suitable size of openings or reinforcements, according to particular needs.

According to embodiments, the material of the brim 120 comprises a semi-rigid or flexible substrate, such as, for example, polymer, foam, stiffened fabric, or other like materials. According to other embodiments, embodiments contemplate the brim 120 formed of a single piece, and coupled with the hat 110 by sewing, adhesive, or the like.

Although features of the hat 110 apparatus are illustrated as comprising various components, embodiments contemplate any feature being composed of more than one piece or multiple features being combined into a single piece, according to particular needs. Additionally, embodiments contemplate any feature coupling with any other feature by any suitable coupling of components such as with adhesive, sewing, a fastener (e.g. a bolt and a nut, a screw, a clip, a rivet, a pin, hook and loop fastener, and/or the like), washers, retainers, straps, wrapping, wiring, a weld joint, a solder joint, and any combination of the foregoing.

Although specific materials for each of the features of the present disclosure have been presented, embodiments contemplate various types of materials or combinations thereof that can readily be formed into shaped objects provided that the materials selected are consistent with the intended operation of the hat apparatus. For example, the components may be formed of: fabrics, polymers, such as thermoplastics and thermosets; rubbers (synthetic and/or natural); composites, such as carbon-fiber; metals; alloys; any other suitable material; and/or any combination of the foregoing.

Reference in the foregoing specification to "one embodiment", "an embodiment", or "some embodiments" means that a particular feature, structure, or characteristic described in connection with the embodiment is included in at least one embodiment of the invention. The appearances of the phrase "in one embodiment" in various places in the specification are not necessarily all referring to the same embodiment.

While the exemplary embodiments have been shown and described, it will be understood that various changes and modifications to the foregoing embodiments may become apparent to those skilled in the art without departing from the spirit and scope of the present invention.

What is claimed is:

1. A hat, comprising:

a single-piece brim comprising a front portion, a back portion, and side edges;

a crown having a front portion, a back portion and a bottom portion;

the bottom portion of the crown including a bottom perimeter;

the crown directly engaged with the back portion of the brim, a flexible band located on an inner circumference of the bottom perimeter of the crown, wherein the flexible band is configured to lay directly against a forehead of a user;

the flexible band having a first portion and a second portion, wherein the first portion of the flexible band is directly connected to the bottom perimeter of the crown, and wherein the second portion of the flexible band is spaced apart from the front portion of the crown such that a channel is formed in between the flexible band and the bottom portion of the crown;

the brim comprising a plurality of intake ports placed in the back portion of the brim and in communication with the channel;

wherein each of the plurality of intake ports are separated from an adjacent intake port of the plurality of intake ports by one or more reinforcements;

wherein the brim comprises a plurality of structural tabs that attach the brim to the flexible band, and wherein each of the plurality of structural tabs are separated from an adjacent structural tab of the plurality of structural tabs by a space.

2. The hat of claim 1, wherein the plurality of structural tabs are perpendicular to the brim.

3. The hat of claim 2, wherein each of the plurality of structural tabs are spaced apart from each of the plurality of intake ports.

4. The hat of claim 1, further comprising a gap between a back edge of the brim and each of the plurality of intake ports, wherein the flexible band connects with the gap.

5. The hat of claim 1, wherein the crown comprises one or more exhaust ports.

6. The hat of claim 5, wherein the one or more exhaust ports are located on at least one of the back portion or sides of the crown.

7. The hat of claim 5, wherein the hat is configured such that air is capable of flowing through the plurality of intake ports, directly into the channel between the flexible band and the bottom portion of the crown, then directly into an interior of the crown.

8. The hat of claim 1, wherein the one or more reinforcements are one-eighth of an inch wide.

9. The hat of claim 1, wherein the side edges of the brim directly interface with the front portion of the crown.

10. The hat of claim 1, wherein the back portion of the brim is curved to interface with the flexible band.

11. The hat of claim 1, wherein the plurality of structural tabs comprises twenty structural tabs.

12. The hat of claim 1, wherein the plurality of intake ports comprises four intake ports.

13. The hat of claim 1, wherein the plurality of intake ports comprises six intake ports.

14. The hat of claim 1, wherein the plurality of intake ports comprises ten intake ports.

* * * * *